US006547611B1

(12) United States Patent
Boroos et al.

(10) Patent No.: US 6,547,611 B1
(45) Date of Patent: Apr. 15, 2003

(54) ELECTRIC REVERSE SYSTEM FOR PERSONAL WATERCRAFT

(75) Inventors: Bart O. Boroos, Stuart, FL (US); Alan T. Hovda, Spencer, IA (US); Kevan Rusk, Spirit Lake, IA (US); Todd D. Dannenberg, Rogers, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 09/374,792

(22) Filed: Aug. 16, 1999

(51) Int. Cl.[7] ..... B63H 11/11
(52) U.S. Cl. ..... 440/41; 440/42
(58) Field of Search ..... 440/38, 40, 41, 440/42, 47; 318/588

(56) References Cited

U.S. PATENT DOCUMENTS

| | | | | | |
|---|---|---|---|---|---|
| 3,782,320 | A | * | 1/1974 | Groves, Jr. | 115/12 R |
| 4,005,674 | A | * | 2/1977 | Davis | 338/183 |
| 4,051,801 | A | | 10/1977 | Woodfill et al. | 115/12 R |
| 4,084,536 | A | * | 4/1978 | Stansbury | 114/151 |
| 4,100,877 | A | * | 7/1978 | Scott et al. | 114/275 |
| 4,223,630 | A | * | 9/1980 | Keeney | 440/41 |
| 4,413,215 | A | * | 11/1983 | Cavil et al. | 318/588 |
| 4,420,741 | A | | 12/1983 | West | 340/29 |
| 5,043,727 | A | | 8/1991 | Ito | 340/984 |
| 5,049,096 | A | * | 9/1991 | Henn | 440/41 |
| 5,062,815 | A | | 11/1991 | Kobayashi | 440/41 |
| 5,067,918 | A | | 11/1991 | Kobayashi | 440/39 |
| 5,151,057 | A | | 9/1992 | Kobayashi et al. | 440/38 |
| 5,154,650 | A | | 10/1992 | Nakase | 440/41 |
| 5,199,913 | A | * | 4/1993 | Toyohara et al. | 440/47 |
| 5,216,421 | A | | 6/1993 | Sawada et al. | 340/984 |
| 5,304,078 | A | * | 4/1994 | Kaneko | 440/41 |
| 5,312,275 | A | * | 5/1994 | Place | 440/41 |
| 5,350,325 | A | | 9/1994 | Nanami | 440/41 |
| 5,474,007 | A | | 12/1995 | Kobayashi | 440/42 |
| 5,494,464 | A | | 2/1996 | Kobayashi et al. | 440/41 |
| 5,507,672 | A | | 4/1996 | Imaeda | 440/1 |
| 5,540,174 | A | | 7/1996 | Kishi et al. | 114/291 |
| 5,551,898 | A | | 9/1996 | Matsumoto | 440/41 |
| 5,593,329 | A | | 1/1997 | Kato | 440/42 |
| 5,603,644 | A | * | 2/1997 | Kobayashi et al. | 440/86 |
| 5,607,332 | A | | 3/1997 | Kobayashi et al. | 440/41 |
| 5,613,887 | A | * | 3/1997 | Kobayashi | 440/47 |
| 5,707,264 | A | * | 1/1998 | Kobayashi et al. | 440/86 |
| 5,752,864 | A | | 5/1998 | Jones et al. | 440/41 |
| 5,755,601 | A | | 5/1998 | Jones | 440/1 |
| 5,934,954 | A | * | 8/1999 | Schott et al. | 440/41 |

* cited by examiner

*Primary Examiner*—S. Joseph Morano
*Assistant Examiner*—Lars A Olson
(74) *Attorney, Agent, or Firm*—Fredrikson & Byron, P.A.

(57) ABSTRACT

A personal watercraft having an electrical reverse mechanism is disclosed. The electric reverse mechanism has a reverse thrust gate mechanically pivotable by an electric motor between a full-up position to permit full-forward propulsion of the watercraft and a fill-down position to enable either full-reverse propulsion or braking of the watercraft. The electric reverse mechanism may include a directional control toggle switch that outputs to the motor a forward signal when toggled to a forward position and a reverse signal when toggled to a reverse position. The motor pivots the reverse gate toward the full-up position when receiving the forward.signal and toward the full-down position when receiving the reverse signal. The electric reverse mechanism may include a display meter that displays an indication of the relative position of the reverse gate between the full-up and full-down positions. The electric reverse mechanism may include a reverse indicator that indicates when the reverse gate is not in the full-up position.

33 Claims, 7 Drawing Sheets

ELECTRIC REVERSE SYSTEM FOR PERSONAL WATERCRAFT

FIELD OF THE INVENTION

The present invention relates to reverse systems for personal watercraft, and in particular, to an electrical reverse mechanism for personal watercraft.

BACKGROUND OF THE INVENTION

Jet-propelled personal watercraft have become very popular for recreational boating. Such watercraft are characterized by having a hull containing an internal combustion engine for powering the watercraft, a deck portion providing a passenger area with controls operable by an operator in the passenger area, and a raised, longitudinally extending seat adapted to accommodate one or more riders seated in, straddle fashion on the seat. The engine powers a jet propulsion unit mounted in the bottom rear portion of the hull, the jet propulsion unit including a steerable water discharge nozzle. The controls include a set of generally transversely extending handlebars operatively connected to the steerable water discharge nozzle to facilitate steering of the watercraft by the operator. A reverse thrust gate can be positioned behind the water discharge nozzle to deflect at least a portion of the jet of water forward and underneath the watercraft in order to provide reverse propulsion of the watercraft. When positioned behind the water discharge nozzle, the reverse thrust gate may also providing braking thrust to the watercraft by creating a drag against the forward movement of the watercraft in the water.

Typical reverse thrust gates must be deployed via a manual shift control located nearby the watercraft's throttle control. Such manual shift controls require the watercraft operator to remove a hand from the throttle control in order to shift from forward to reverse or from reverse to forward, leaving only one hand to steer the watercraft. In addition, in such known types of watercraft, operators cannot determine the position of the reverse gate between forward and reverse without altering their field of vision from the path ahead in order to either attempt to lean over the back of the watercraft and visually determine the position of the reverse gate or at least to the side of the watercraft to check the position of the manual shift lever.

SUMMARY OF THE INVENTION

An electrical reverse mechanism in a jet propelled personal watercraft having a jet pump with a nozzle that outputs a jet of water rearward of the watercraft for its propulsion, the watercraft having a hull defining a rider's area to accomodate a rider. The electrical reverse mechanism includes a reverse thrust gate that is mounted adjacent to the nozzle and is mechanically pivotable by an electric motor between two positions, full-up and full-down. In the full-up position, the reverse thrust gate permits full-forward propulsion of the watercraft. In the full-down position, the reverse thrust gate permits either full-reverse propulsion or braking of the watercraft.

The electrical reverse mechanism may include a directional control toggle switch positioned nearby the rider's area. The toggle switch outputs a forward signal when it is toggled to a forward position, and a reverse, signal when it is toggled to a reverse position. The motor pivots the reverse gate based on the signals supplied to, it by the toggle switch. The motor pivots the reverse gate towards the full-up position when receiving the forward signal and towards the full-down position when receiving the reverse signal.

The electrical reverse mechanism may include a display meter that displays an indication of the relative position of the reverse gate between the fill-up and fill-down positions.

The electric reverse mechanism may include a reverse indicator that indicates when the reverse gate is not in the full-up position.

DETAILED DESCRIPTION OF THE INVENTION

Figure 1:
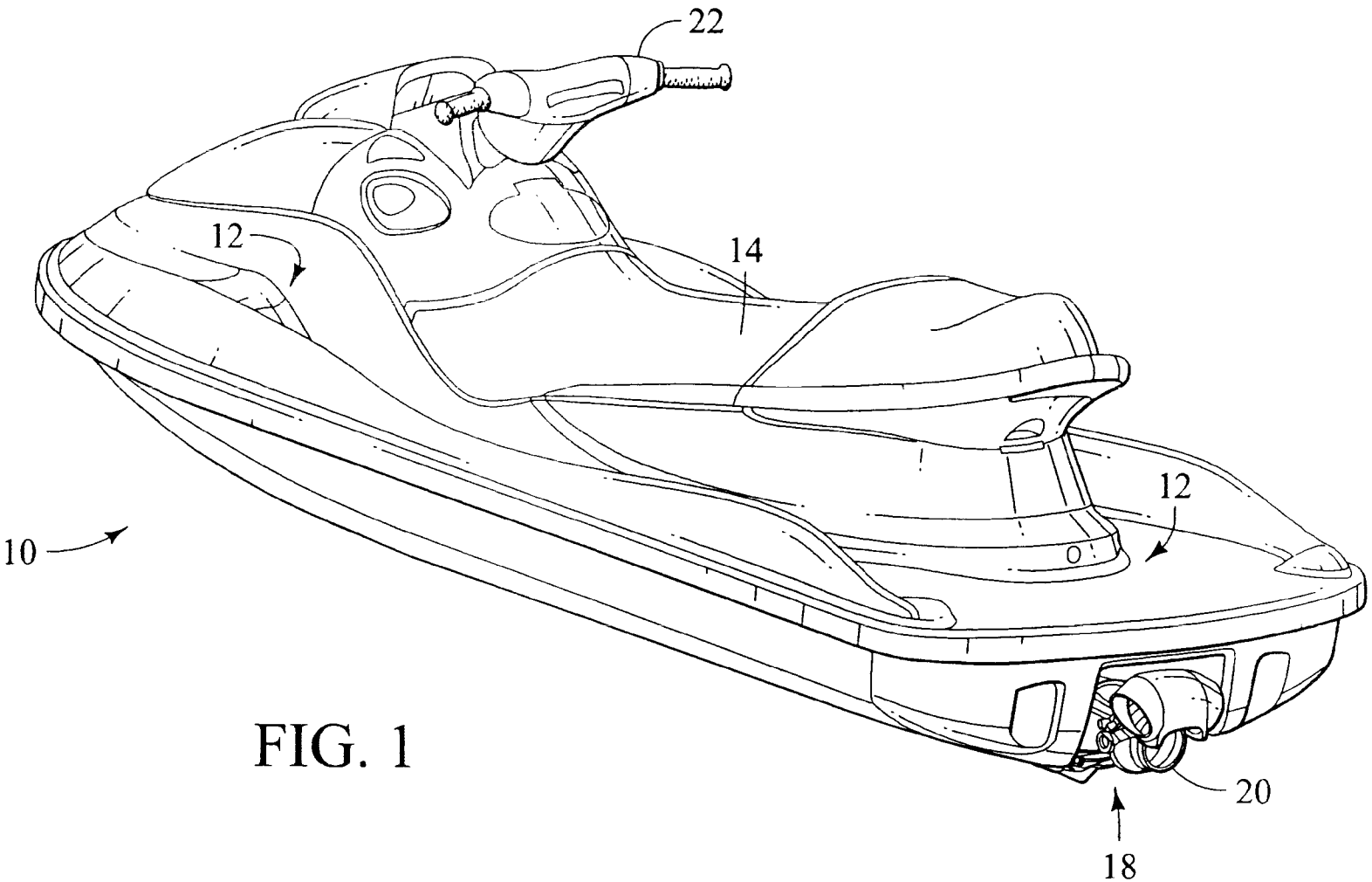
FIG. 1 is a perspective view of a personal watercraft of the invention.

The drawings depict a preferred embodiment of a personal watercraft incorporating the electrical reverse mechanism of the invention. It will be understood, however, that many of the specific details of the personal watercraft with an electrical reverse mechanism illustrated in the drawings could be changed or modified by one of ordinary skill in the art without departing significantly from the spirit of the invention.

Figure 2:
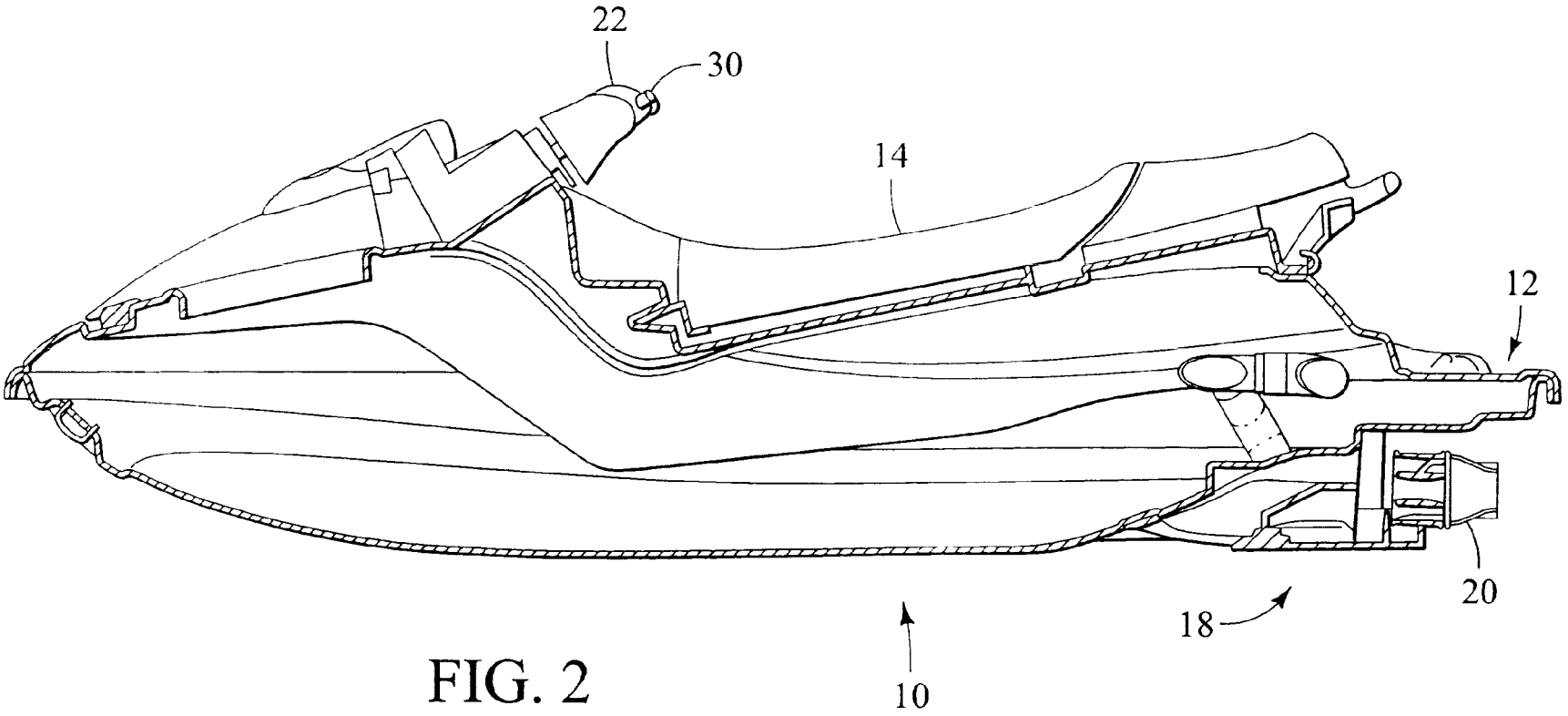
FIG. 2 is a cross-sectional view of the personal watercraft of FIG. 1, taken generally along the centerline of the watercraft.

FIGS. 1–2 depict generally a preferred embodiment of a jet-propelled personal watercraft of the invention. Such a watercraft includes an outer hull designated generally by the reference numeral 10. The hull 10 includes a compartment sized to contain an internal combustion engine for powering the watercraft, and may also include one or more storage compartments, depending upon the size and configuration of the watercraft. The hull 10 includes a deck portion 12 providing a passenger area containing controls operable by an operator in the passenger area. The deck portion 12 also has a raised, longitudinally extending seat 14 adapted to accommodate at least two riders—an adult and a child—seated in straddle fashion on the seat 14. A jet propulsion unit or jet pump 18, typically mounted at the bottom rear portion of the watercraft, is powered by the engine. The jet pump 18 includes a steerable water discharge nozzle 20. The jet pump 18 outputs a jet of water rearward of the watercraft for propulsion of the watercraft. The steerable water discharge nozzle 20 is operatively connected to a set of handlebars 22 to facilitate steering of the watercraft by the operator. Such connection may be of any suitable type, and typically includes mechanical linkages including a control cable. If desired, an electronic connection could also be utilized. A throttle control 16 is positioned on the right handlebar contiguous to a rider's area. The throttle control 16 may be used by a rider to throttle the engine and increase the output of water pumped rearward through the nozzle 20 by the jet pump 18.

Figure 3:
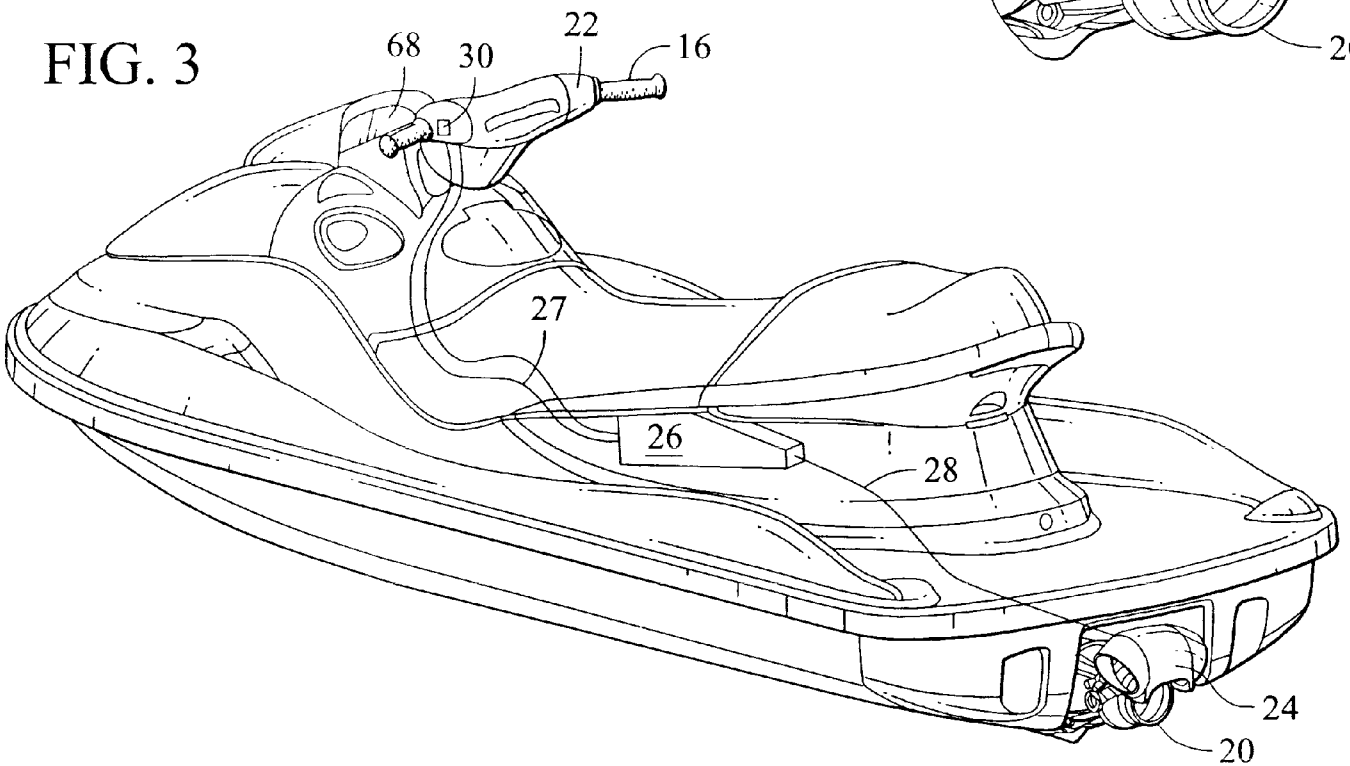
FIG. 3 is a perspective view of a personal watercraft showing a schematic representation of the electrical reverse mechanism of the invention.

FIG. 3 is a perspective view of the personal watercraft shown in FIGS. 1–2 that also provides a schematic representation of the electrical reverse mechanism of the invention. A reverse thrust bucket or gate 24 is mounted adjacent to nozzle 20 the watercraft. When the reverse gate 24 is located in the full-up position, as shown more clearly in the exploded view provided by FIG. 4, the jet propulsion unit 18 provides forward propulsion of the watercraft. As indicated by the arrow in FIG. 4, the reverse thrust gate may be pivoted down (clockwise as diagrammed) from the full-up position towards the full-down position. Pivoted to the full-down position, the reverse gate 24 is located rearward of the nozzle 20 for reverse propulsion of the watercraft, or braking thrust when the watercraft is moving in the forward direction. In addition, neutral thrust may be achieved by pivoting the reverse gate 24 in an intermediate or neutral position between the full-up and full-down positions.

Referring back to FIG. 3, the pivot of the reverse thrust gate 24 is actuated by an electrical motor 26 that is mechanically linked to the reverse thrust gate 24 by a wire cable 28, as will be described in detail below. The motor 26 is electrically wired 27 to a directional control toggle switch 30. The toggle switch 30 is mounted nearby the handlebar opposite the location of the throttle control 16. Accordingly, the rider may operate the toggle switch 30 without having to release either hand from the steering controls (handlebars 22) or throttle control 16.

Figure 5:
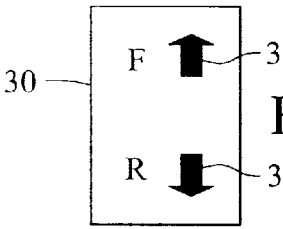
FIG. 5 is a schematic diagram of a directional control toggle switch of the electrical reverse mechanism of the invention.

A preferred embodiment of the toggle switch 30 is shown schematically in FIG. 5. The toggle switch 30 has forward 32 and reverse 34 buttons. Depression of the forward button 32 will cause the motor to pivot the reverse gate 24 towards the full-up position for forward propulsion and, correspondingly, depression of the reverse button 34 causes the motor to pivot the reverse gate towards the full-down position for reverse propulsion. The toggle switch may also be equipped with an off button or off position for no movement of the reverse gate 24. In the embodiment shown in FIG. 5, however, depression of neither the forward 32 or reverse 34 buttons functions as an off position where the motor will prevent the reverse gate from pivoting towards either the full-up or full-down positions.

Figure 6:
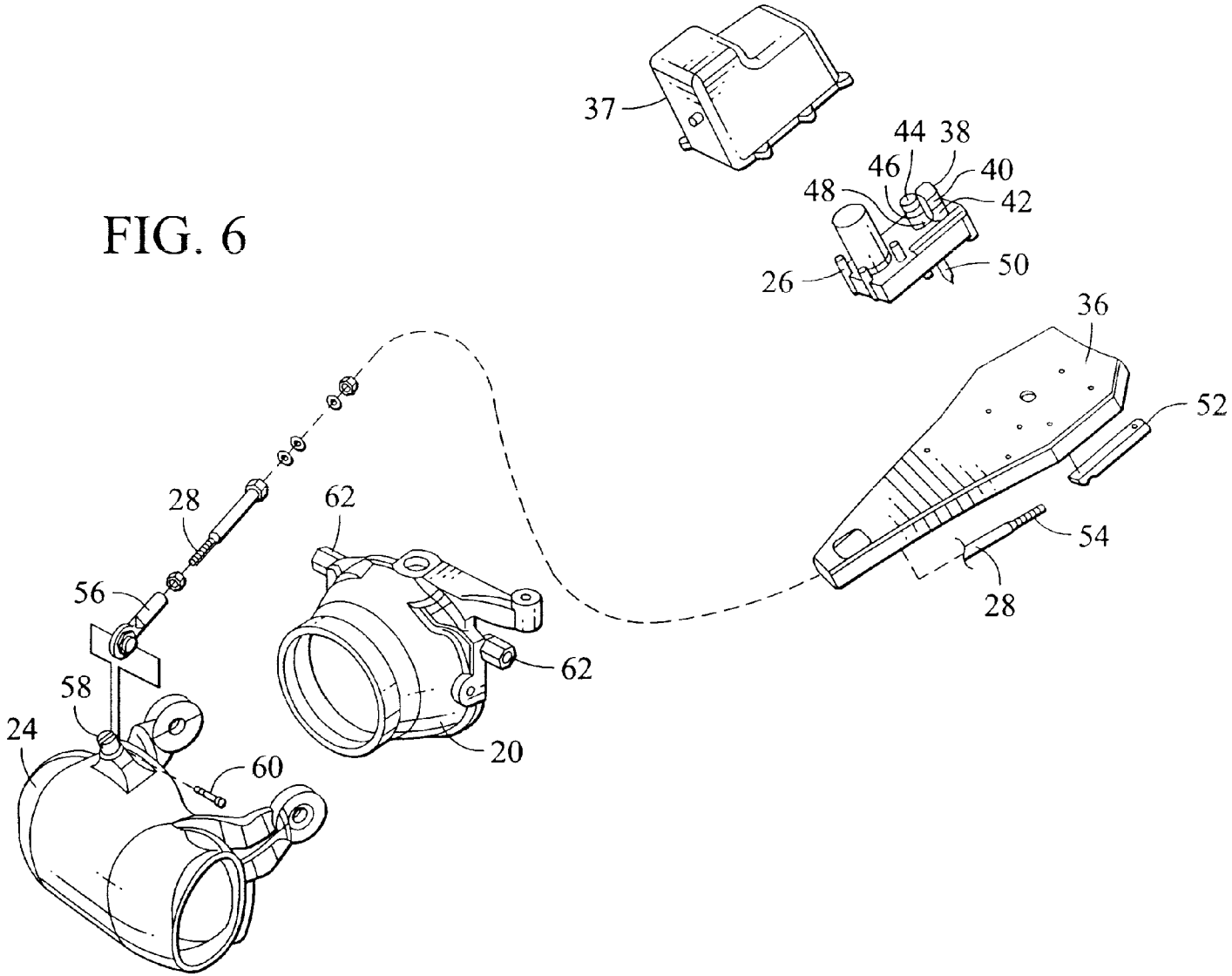
FIG. 6 is an exploded view of the electric reverse motor and linkage to the reverse gate of the electrical reverse mechanism of the invention.

A preferred embodiment of the electrical reverse motor 26 including the mechanical linkage 28 to the reverse gate 24 is shown in detail in FIG. 6. A motor bracket 36 is mounted within the hull 10 of the watercraft. The motor assembly 26 is secured onto the motor bracket 36 and is sealed with a cover 37.

The motor 26 has three limit switches 38, 40, and 42 that are closed by three corresponding cams 44, 46, and 48 which rotate with a rotating shaft 50 of the motor. The first two limit switches 38 and 40 are closed by cams 44 and 46, respectively, when the motor 26 rotates into the position where the reverse gate 24 is in the full-up position. The third limit switch 42 is closed by cam 48 when the motor travels to the position where the reverse gate 24 is in the full-down position. When not closed by a cam, each switch remains open. Accordingly, at all motor positions between the full-up and full-down positions, the limit switches are open. As discussed further below, the first and third limit switches 38 and 42 prevent the motor from traveling past the point where the reverse gate is pivoted to the full-up and full-down positions, respectively. The second limit switch 40 helps provide an indication of whether the reverse gate 24 is in the full-up position. In an alternative embodiment, additional limit switches and corresponding cams could be used to provide an indication of the position of the motor.

The shaft 50 of the motor 26 protrudes through a hole in the bracket 36 and is connected to a reverse linkage 52. The linkage 52 is pivotally attached to a rod end 54 of the wire cable 28. The wire cable 28 is mounted to fittings as it passes through the hull 10 to the rear portion of the watercraft where another rod end 56 of the wire cable 28 is pivotally attached to a cable mounting bracket 58 on the reverse gate 24. The rod end 56 and the mounting bracket 58 have an eyelets within which a pin 60 is secured. The reverse gate 24 is mounted to rotate or pivot towards full-down (clockwise as diagrammed in FIG. 6) or towards full-up (counter-clockwise as diagrammed) on flanges 62 about the nozzle 20.

Figure 4:
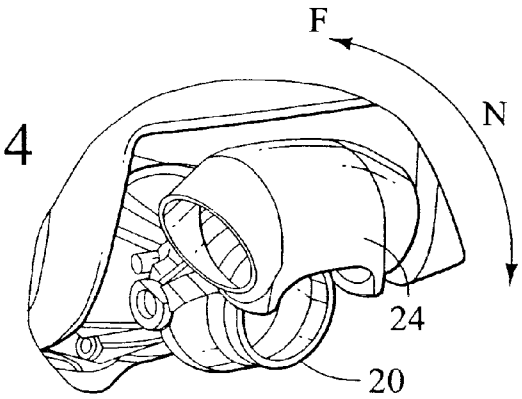
FIG. 4 is a broken away view of the reverse thrust gate portion of the personal watercraft shown in FIG. 3.

When the motor rotates forward during operation, the reverse linkage 52 rotates correspondingly and pulls the wire cable 28. The pulling of the wire cable 28 effects a clockwise pivot of the reverse gate 24 to the full-up position (as shown in FIGS. 1, 3–4). When the motor rotates in reverse, the reverse linkage 52 pushes the wire cable 28 to effect a counter-clockwise pivot of the reverse gate 24 to the full-down position.

The motor 26 is preferably a DC motor and is coupled a gear reduction system to control the output speed and the holding torque of the system. Accordingly, the motor can also be rotated to any intermediate point between the full-up and full-down position where the motor will prevent the reverse gate 24 from pivoting up or down, even under the force of the moving water surrounding the reverse gate 24. Alternative mechanisms could also be used to provide the necessary holding torque.

Figure 7:
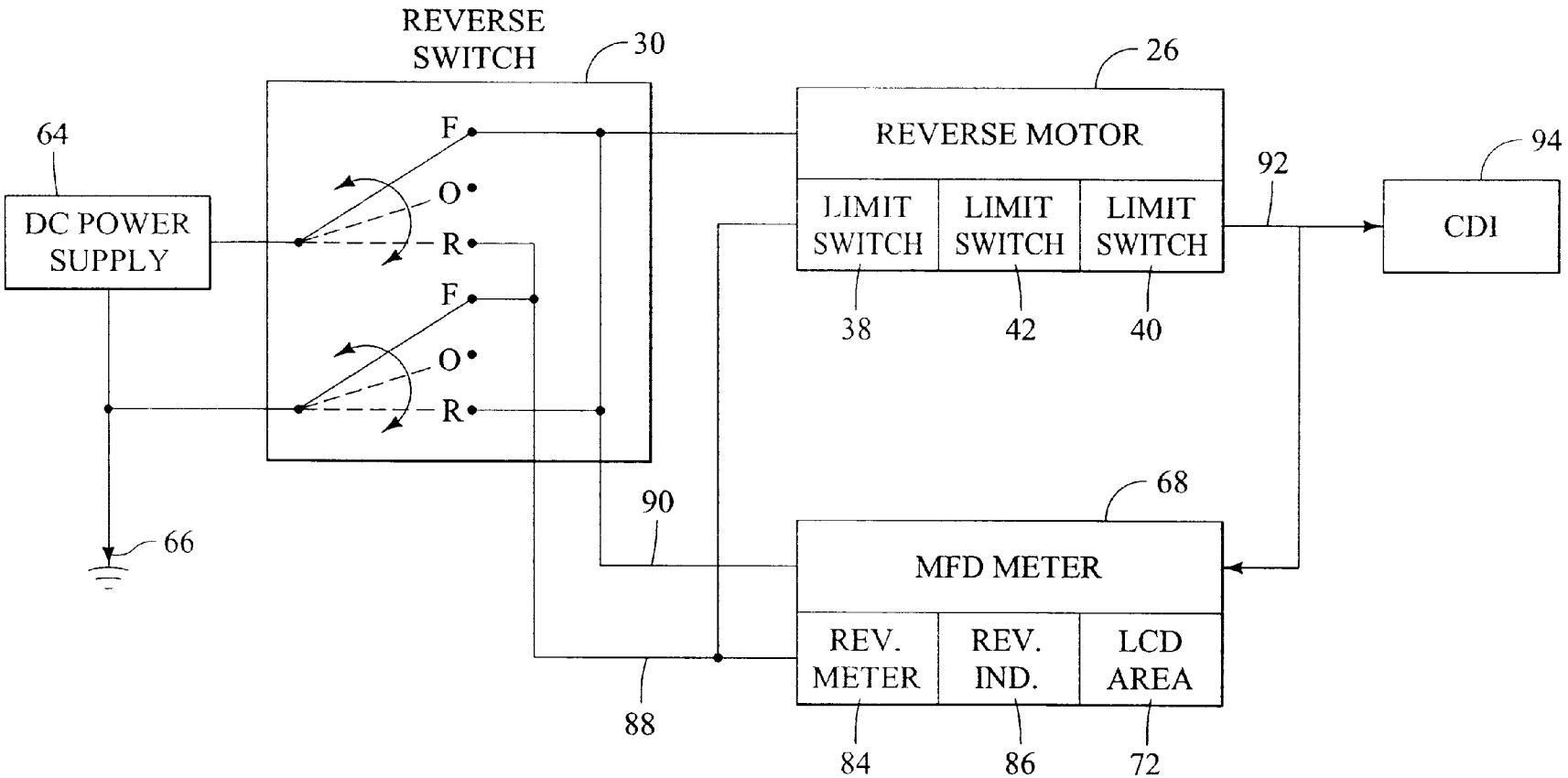
FIG. 7 is an electrical schematic diagram of the reverse switch and the MFD meter of the electrical reverse mechanism of the invention.

FIG. 7 provides an electrical schematic diagram of the reverse switch and other components of the electrical reverse mechanism of the invention. The electrical system is powered by a 12 Volt DC power supply 64. The power supply 64 may be provided by the watercraft battery, or preferably, by regulated voltage developed by an exciter coil in the engine stator. A negative lead of the power supply 64 is connected to an effective system ground 66, typically provided by the engine block.

The 12 volts DC from the power supply 64 are preferably connected to a three way toggle switch 30. Other types of switches could, of course, also be used. When switched to the forward position F (as displayed in solid lines in FIG. 7), the reverse switch 30 connects the 12 VDC to the reverse motor 26. In this configuration, the reverse motor 26 will pivot the reverse gate 24 towards the full-up position for forward propulsion. When switched to the reverse position R (as displayed with dotted lines), the reverse switch 30 connects the 12 VDC to the reverse motor 26, but with reversed polarity. In this configuration, the reverse motor 26 will reverse directions and will pivot the reverse gate 24 towards the full-down position, enabling reverse propulsion or braking. The reverse switch 30 defaults to the off or open position 6 (shown in dotted lines), where the 12 VDC provided by the power supply is cut off from the motor 26. In the off configuration, the reverse motor 26 will restrict the reverse gate 24 from pivoting towards either the full-up or full-down positions.

Figure 8:
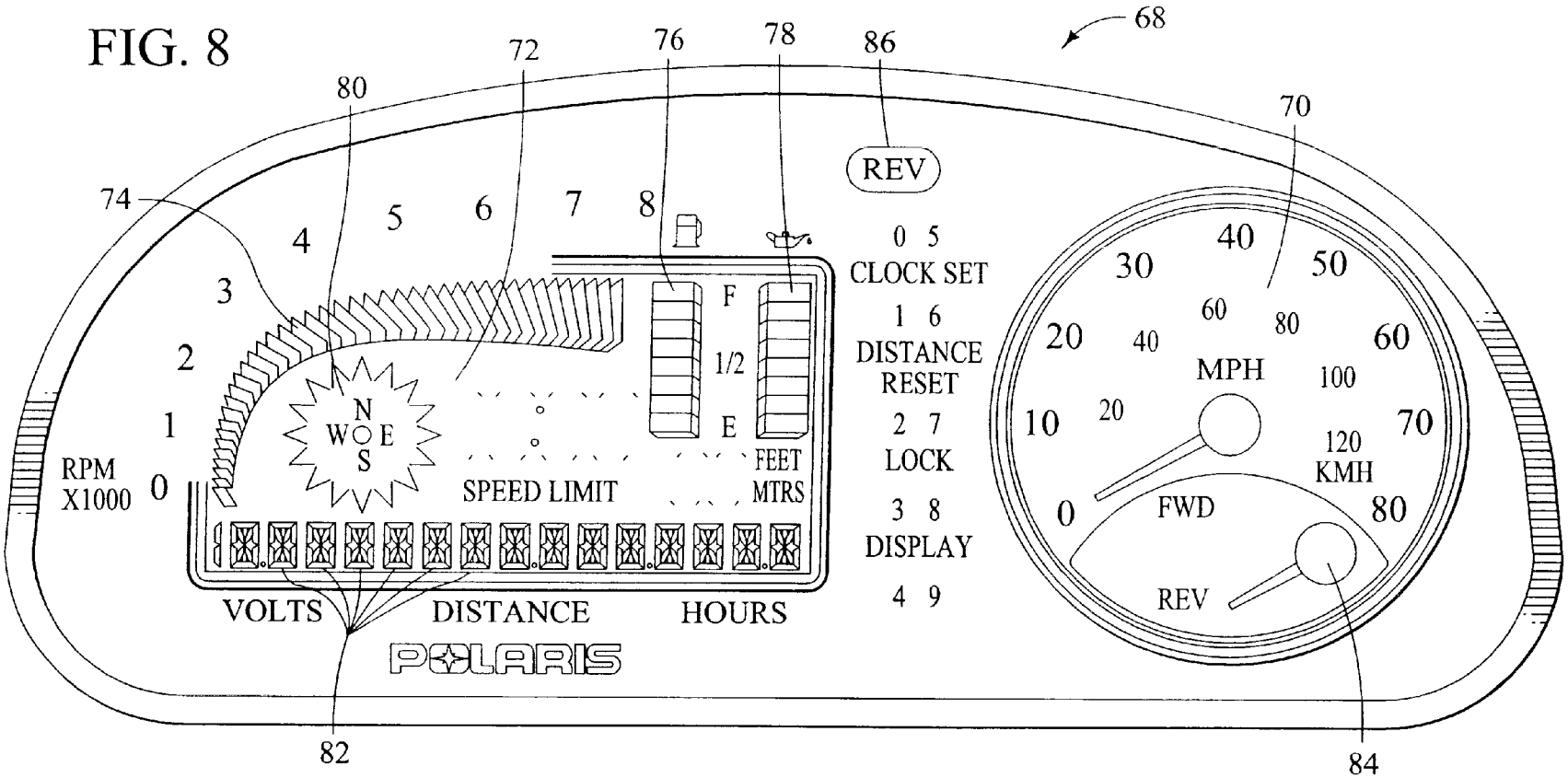
FIG. 8 is an enlarged view of a multiple function display meter of the electrical reverse mechanism of the invention.

Besides connecting to the reverse motor 26, the output of the reverse switch 30 is also connected to an electronic multi-function display (MFD) meter 68. The MFD meter 68 is preferably located forward of the handlebars 22, as shown in FIG. 3, for easy viewing by the operator of the personal watercraft. However, the MFD meter 68 could be mounted anywhere on the personal watercraft. FIG. 8 shows a typical display for the MFD meter 68. As shown, the MFD meter 68 provides several vehicle indicators typical of MFD meters. For instance, the MFD meter 68 provides an analog dial speedometer 70, and an LCD display area 72 within which is displayed such typical vehicle indicators as a tachometer 74, a fuel level gauge 76, an oil pressure gauge 78, and a compass 80. In addition, the LCD area provides a series of multiple-segment displays 82 that may each display an alphanumeric character that comprises a message to the watercraft operator regarding the watercraft.

The MFD meter 68 also provides unique functions relating to the electric reverse. For instance, the MFD meter 68 provides an analog dial meter 84 that indicates the relative position of the reverse gate 24 between full-forward and full-reverse. This reverse meter 84 could also be provided in some other manner, such as digitally, audibly, etc. The MFD meter 68 also provides a reverse indicator 86 that is preferably comprised of an LED that flashes at the rider when the reverse gate 24 is in any position other than full-forward. The reverse indicator 86 may instead be an audible signal. The series of multi-segment displays 82 may also function as a reverse indicator by displaying words such as "REVERSE" or "FORWARD" to indicate the position or status of the reverse gate 24.

Referring back to FIG. 7, the MFD meter 68 is shown schematically to include at least the LCD display area 72, the reverse meter 84, and the reverse indicator 86. As stated previously, the output of the reverse switch 30 is connected to the electronic multi-function display (MFD) meter 68. The reverse meter 84 dial display reacts directly to the output of the reverse switch 30. For instance, when the reverse switch 30 leads are set to R (as shown in dotted line form), the 12 VDC received by the MFD meter 68 on conductor 88 causes the dial display to move at a constant rate from pointing towards FWD to pointing towards REV. The longer the reverse switch is set to R, the further the dial display will move towards REV in order to indicate the relative position of the reverse gate 24 to the watercraft operator. When the reverse gate 24 is pivoted to the full-reverse position, limit switch 42 is triggered. As will be discussed in detail below, limit switch 42 cuts off power to the reverse motor, preventing it from rotating any further in reverse. After the limit switch 42 cuts off power to the reverse motor or when the reverse switch 30 leads are set to O (off position shown in dotted line form), the reverse meter 84, of course, remains in its current position.

When the reverse switch 30 leads are switched to F (as shown in solid line form), the 12 VDC received by the MFD meter 68 on conductor 90 causes the dial display to move at a constant rate from pointing towards REV to pointing towards FWD. When the reverse gate 24 is pivoted to the full-up position, limit switches 38 and 40 are triggered. In an alternate embodiment, limit switches 38 and 40 could be consolidated into a single limit switch. In another alternate embodiment, limit switches 38, 40, and 42 could be replaced with other mechanisms that measure or sense the position of the reverse gate, such as position sensors mounted nearby the reverse gate, or electronics that precisely measure the amount of current supplied to the reverse motor or the amount of time current is applied to the motor.

In the preferred embodiment, a separate limit switch 38 cuts off power to the reverse motor 26, preventing it from rotating any further forward as will be discussed in detail below. The signal 92 provided by limit switch 40 (or, alternatively, lack of a signal) when triggered provides several functions.

The full-forward signal 92 is provided back to the MFD meter 68 as shown in FIG. 7. This signal 92 resets the position of the reverse meter 84 to the FWD position. The full-forward signal 92 resets the reverse meter 84 each time the reverse gate is pivoted to the full-forward position in case the reverse meter 84 is out of calibration or is not accurately displaying the relative position of the reverse gate 24. In addition, the full forward signal 92 triggers functions in the LCD display area 72 and of the reverse indicator 86 on the MFD meter 68. For instance, when the full forward signal 92 is present (i.e., when limit switch 40 is triggered), the LCD 72 may display the word FORWARD. When the full-forward signal 92 is removed (i.e., when the motor moves from the full-forward position and opens limit switch 40), the LCD 72 may display the word REVERSE. In an alternate embodiment, the LCD's display of REVERSE may instead be triggered by a full-reverse condition sensed by limit switch 42. In addition, limit switch 40 may instead be configured to open, not close, when the motor reaches the full-forward position, thereby enabling the LCD and the reverse meter to react to the absence, not presence, of the full-forward signal.

Similar to the LCD 72, the reverse indicator 86 may also be triggered by the full forward signal 92. When the reverse gate is in the full-up position, the full-forward signal 92 may signal this condition to reverse indicator 86, causing the reverse indicator to shut off. When the reverse gate is pivoted from the full-up position, however, the full-forward signal will signal this change to the reverse indicator 86, causing the reverse indicator light 86 to preferably flash repeatedly at the vehicle operator to note a condition other than full-forward.

The full-forward signal 92 may also be used to limit the reverse propulsion of the watercraft. As shown in FIG. 7, the full-forward signal 92 is also supplied to the ignition system's capacitive discharge ignition system (CDI) 94. The CDI 94 dictates the timing of the spark generation to the cylinders in the engine. When the reverse gate is not in the full-forward position, the full-forward signal 92 may signal this situation to the CDI. In such circumstances, the CDI 94 may respond by limiting the engine RPM to a certain amount, such as 3500 RPM. This limits the speed at which the operator may drive the personal watercraft in reverse. When the reverse gate 24 is returned to the full-forward position, the full-forward signal 92 may signal to the CDI 94 to again permit full engine RPM.

Figure 9:
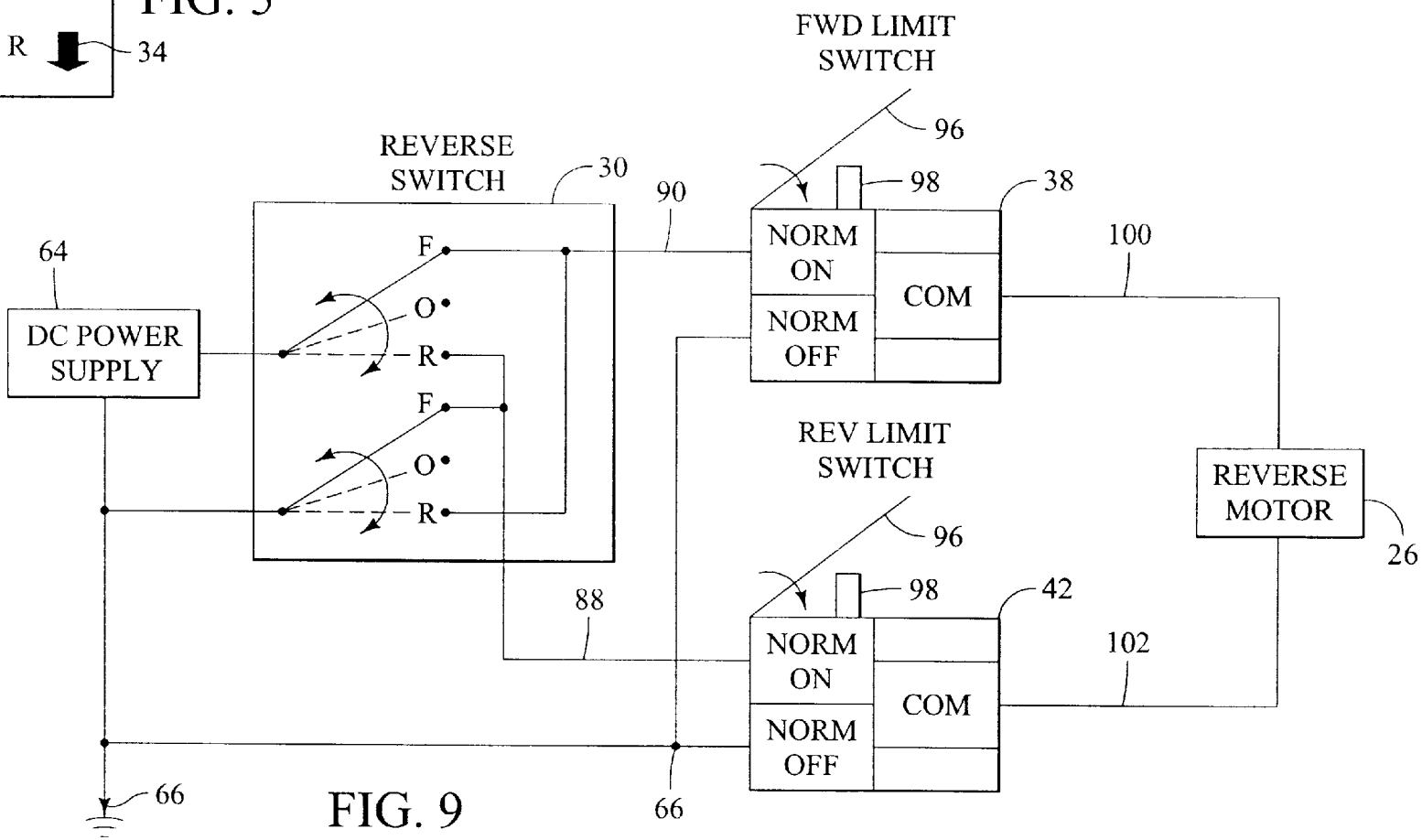
FIG. 9 is an electrical schematic diagram of the limit switches of the electric reverse mechanism of the invention.

As mentioned above, when the reverse gate 24 is pivoted to the full-reverse position, limit switch 42 is triggered. Limit switch 42 cuts off power to the reverse motor, thereby preventing it from rotating any further in reverse even if the depression of the reverse button 34 is maintained. Correspondingly, when the reverse gate 24 is pivoted to the full-up position, limit switch 38 is triggered. Limit switch 38 cuts off power to the reverse motor to prevent it from rotating any further forward even if the depression of the forward button 32 is maintained. After either of the limit switches 38 or 42 cuts off power to the reverse motor or when the reverse switch 30 is set to O (off), the reverse meter 84, of course, remains in its current position. FIG. 9 provides an electrical schematic diagram of how limit switches 38 and 42 provide this operation.

Each limit switch 38, 42 has three terminals, "normally on", "normally off" and "common". Each switch also has an actuator 96 and a contact 98. As discussed above, cams 44 and 48 rotate with the shaft of the motor 26 and trigger limit switches 38, 42 when the motor 26 reaches the full-up or full-down positions, respectively. The cams 44, 48 trigger switches 38, 42 by pressing each switch's actuator 96 into its respective contact 98. Without the action provided by cams 44, 48, each switch's actuator 96 remains in its normal position, separate from its contact 98. In this normal position, the switches 38, 42 "normally on" terminal is connected to its "common terminal". The "normally off" terminal in this normal position is disconnected from the other terminals. When the switch 38, 42 is triggered, however, the connection between the "normally off" terminal and the "common" terminal is broken. The "common" terminal is instead connected to the "normally off" terminal. The "normally on" terminal is left disconnected from the other terminals.

As shown in FIG. 9, the "normally on" terminal of forward limiting switch 38 is connected to one side of the reverse switch 30 via conductor 90. The "normally on" terminal of the reverse limiting switch 42 is connected to the other side of the reverse switch 30 via conductor 88. Each switches 38, 42 "normally off" terminal is connected to the system ground 66, and the switches 38, 42 "common" terminals are connected to opposite sides of the reverse motor 26 via conductors 100 and 102, respectively.

The connections provided during normal forward operation (when the reverse switch leads are switched to F and the motor 26 is not already in full-up position) are as follows. The reverse switch connects the 12 VDC from power supply 64 to lead 90 and connects lead 88 to ground 66. Switch 38 connects conductor 90 to conductor 100 since the "normally on" terminal is normally connected to the "common terminal". Conductor 100 provides the 12 VDC to the reverse motor 26 through a return path over conductor 102. Switch 42 connects conductor 102 to conductor 88 since the "common" terminal is normally connected to the "normally on" terminal. Since conductor 88 provides a path to ground 66, the 12 VDC applied to reverse motor 26 causes the motor 26 to rotate in the forward direction.

Assuming the motor is allowed to rotate forward until it reaches the full-up position, forward limit switch 38 will trigger. When this occurs, switch 38 disconnects the 12 VDC on conductor 90 from the circuit and connects conductor 100 to ground 66. Accordingly, even with the reverse switch 30 set to F, the motor will not rotate any further forward.

If the reverse switch 30 is switched to R (shown in dotted line form) while the forward limit switch 38 remains triggered, reverse switch 30 will now connect conductor 88 to 12 VDC and conductor 90 to ground 66. As was the case previously, reverse limit switch 42 connects conductor 88 to conductor 102 since switch 42 is still in its normal state. Only switch 38 was triggered when the motor reached the full-up position. The difference now, however, is that reverse limit switch 42 is applying the 12 VDC to the reverse motor 26 instead of providing a ground path for the motor 26. Conductor 100 provides a path to ground since limit switch 38, when triggered, connects conductor 100 on the "common" terminal to ground 66 on the "normally off" terminal. Since conductor 100 provides a path to ground 66, the 12 VDC applied to reverse motor 26 on conductor 102 causes the motor 26 to rotate in the reverse direction.

As the motor 26 begins to rotate in reverse from the full-up position, limit switch 38 returns to its normal condition. When this occurs, conductor 100 continues to provide a return path to ground 66. Switch 38 connects conductor 100 back to conductor 90, Which is connected to ground 66 via reverse switch 30. In this configuration, both switches 38, 42 are in their normal condition.

Similar to reaching the full-up position, reverse limit switch 38 will trigger if the motor 26 is allowed to rotate in reverse until it reaches the full-down position. When this occurs, switch 42 disconnects the 12 VDC on conductor 88 from the circuit and connects conductor 102 to ground 66. Accordingly, even with the reverse switch 30 set to R, the motor will not rotate any further in reverse.

If the reverse switch 30 is switched to F (shown in solid line form) while the reverse limit switch 42 remains triggered, reverse switch 30 will again connect conductor 88 to 12 VDC and conductor 90 to ground 66. Reverse limit switch 38 again connects the 12 VDC on conductor 90 to conductor 100 since switch 38 remains in its normal state. Only switch 42 was triggered when the motor reached the full-down position. Conductor 102 provides a path to ground since limit switch 42, when triggered, connects conductor 102 on the "common" terminal to ground 66 on the "normally off" terminal. Since conductor 102 provides a path to ground 66, the 12 VDC applied to reverse motor 26 on conductor 100 causes the motor 26 to rotate in the forward direction.

As the motor 26 begins to rotate in reverse from the full-up position, limit switch 42 returns to its normal condition. When this occurs, conductor 102 continues to provide a return path to ground 66. Switch 42 connects conductor 102 back to conductor 88, which is connected to ground 66 via reverse switch 30. In this configuration, both switches 38, 42 are in their normal condition.

While a preferred embodiment of the present invention has been described, it should be understood that various changes, adaptations and modifications may be made therein without departing from the spirit of the invention and the scope of the appended claims.

What is claimed is:

1. In a jet propelled watercraft having a jet pump with a nozzle that outputs a jet of water rearward of the watercraft for propulsion of the watercraft, the watercraft having a hull defining a rider's area to accommodate a rider, an electrical reverse mechanism comprising:

a reverse thrust gate mounted adjacent to the nozzle and pivotable between a full-up position for full-forward propulsion and a full-down position for full-rearward propulsion;

a directional control toggle switch positioned contiguous to the rider's area that outputs a forward signal when toggled to a forward position and a reverse signal when toggled to a reverse position; and an electrical motor that receives the signals supplied by the toggle switch and mechanically pivots the reverse gate towards the full-up position when receiving the forward signal and towards the full-down position when receiving the reverse signal, the propulsion of the watercraft being limited during watercraft operation when the reverse gate is not in the full-up position in order to limit the speed at which the operator may operate the watercraft.

2. The electrical reverse system of claim 1 further comprising a display meter that displays an indication of the relative position of the reverse gate between the full-up position and the full-down position based on signals supplied by the toggle switch.

3. The electrical reverse mechanism of claim 1 further comprising a reverse indicator that indicates when the reverse gate is not in the full-up position based on a limiter signal supplied by the motor.

4. The electrical reverse mechanism of claim 1 further comprising an ignition system being supplied with a signal from the motor indicative of whether the reverse gate is in the full-up position, the ignition system limiting the propulsion of the watercraft when the reverse gate is not in the full up position.

5. The electrical reverse mechanism of claim 4 wherein the ignition system permits the full-forward propulsion of the watercraft when the reverse gate is in the full up position.

6. The electrical reverse mechanism of claim 1 wherein the motor has limit switches that automatically stop the motor from further pivoting the reverse gate when the reverse gate is pivoted to the full-up position or the full-down position.

7. The electrical reverse mechanism of claim 1, wherein the reverse gate is pivotable to a neutral position between the full-up position and the full-down position to neutralize propulsion of the watercraft by the jet of water outputted from the nozzle.

8. The electrical reverse mechanism of claim 1, further comprising a throttle control positioned on a first handlebar of the watercraft for controlling the output level of the jet of water, and wherein the toggle switch is positioned nearby a second handlebar of the watercraft opposite the first handlebar, whereby a rider may toggle the toggle switch without releasing the throttle control.

9. The electrical reverse mechanism of claim 1 wherein the directional control toggle switch outputs no signal when not toggled to the forward or reverse positions.

10. The electrical reverse mechanism of claim 1 wherein the electrical motor restricts any pivot of the reverse gate when the toggle switch is toggled to an off position.

11. The electrical reverse mechanism of claim 1 wherein the electrical motor does not pivot the reverse gate when the toggle switch is toggled to an off position.

12. In a jet propelled watercraft having a jet pump with a nozzle that outputs a jet of water rearward of the watercraft for propulsion of the watercraft, the watercraft having a hull defining a rider's area to accommodate a rider, an electrical reverse mechanism comprising:

a reverse thrust gate mounted adjacent to the nozzle and pivotable between a full-up position for full-forward propulsion and a full-down position for full-rearward propulsion; and an electrical motor that mechanically pivots the reverse gate towards the full-up position and towards the full-down position, wherein the propulsion of the watercraft is limited during watercraft operation when the reverse gate is not in the full-up position in order to limit the speed at which the operator may operate the watercraft.

13. The electrical reverse mechanism of claim 12, further comprising a directional control toggle switch positioned contiguous to the rider's area that outputs a forward signal when toggled to a forward position and a reverse signal when toggled to a reverse position.

14. The electrical reverse mechanism of claim 13, wherein the electrical motor receives the signals supplied by the toggle switch and mechanically pivots the reverse gate towards the full-up position when receiving the forward signal and towards the full-down position when receiving the reverse signal.

15. The electrical reverse mechanism of claim 14, further comprising a display meter that displays an indication of the relative position of the reverse gate between the full-up position and the full-down position based on signals supplied by the toggle switch.

16. The electrical reverse mechanism of claim 14, further comprising a reverse indicator that indicates when the reverse gate is not in the full-up position based on a limiter signal supplied by the motor.

17. The electrical reverse mechanism of claim 12, further comprising an ignition system being supplied with a signal from the motor indicative of whether the reverse gate is in the full-up position, the ignition system limiting the propulsion of the watercraft when the reverse gate is not in the full up position.

18. The electrical reverse mechanism of claim 17, wherein the ignition system permits the full-forward propulsion of the watercraft when the reverse gate is in the full up position.

19. The electrical reverse mechanism of claim 12, wherein the propulsion of the watercraft is limited during watercraft operation when the reverse gate is in the full-down position in order to limit the speed at which the operator may operate the watercraft.

20. In a jet propelled watercraft having a jet pump with a nozzle that outputs a jet of water rearward of the watercraft for propulsion of the watercraft, the watercraft having a hull defining a rider's area to accommodate a rider, an electrical reverse mechanism comprising:

a reverse thrust gate mounted adjacent to the nozzle and pivotable between a full-up position for full-forward propulsion and a full-down position for full-rearward propulsion; and a electrical motor that mechanically pivots the reverse gate between the full-up position and the full-down position, the motor having a limit switch that automatically stops the motor from further pivoting the reverse gate when the reverse gate is pivoted to the full-up position.

21. The electric reverse mechanism of claim 20, further comprising another limit switch that automatically stops the motor from further pivoting the reverse gate when the reverse gate is pivoted to the full-down position.

22. The electrical reverse mechanism of claim 21, further comprising a display that displays an indication of the position of the reverse gate as pivoted by the motor between the full-up position and the full-down position.

23. The electrical reverse mechanism of claim 22 wherein the display is a display meter that displays an indication of the relative position of the reverse gate as pivoted by the motor between the full-up position and the full-down position.

24. The electrical reverse mechanism of claim 23 wherein the display meter changes its indication of the relative position of the reverse gate at a constant rate based on the length of time the toggle switch outputs the forward or reverse signals.

25. The electrical reverse mechanism of claim 22, further comprising a directional control toggle switch positioned contiguous to the rider's area that outputs a forward signal to the display when toggled to a forward position and a reverse signal to the display when toggled to a reverse position, the display basing its indication of the position of the reverse gate on the output signals supplied by the toggle switch.

26. The electrical reverse mechanism of claim 20, further comprising a reverse indicator that indicates when the reverse gate is not in the full-up position, the reverse indicators indicating when the reverse gate is not in the full-up position based on a signal supplied by the motor.

27. The electrical reverse mechanism of claim 26, wherein the indication provided by the reverse indicator when the reverse gate is not in the full-up position is visible or audible.

28. The electrical reverse mechanism of claim 26, wherein the indication provided by the reverse indicator when the reverse gate is not in the full-up position comprises a flashing LED.

29. The electrical reverse mechanism of claim 26 wherein the signal supplied by the motor is generated from the limit switch on the motor, the limit switch being tripped when the reverse gate is pivoted to the full-up position.

30. The electrical reverse mechanism of claim 26, wherein the reverse indicator displays an indication of the relative position of the reverse gate as pivoted by the motor between the full-up and full-down positions.

31. The electrical reverse mechanism of claim 30 wherein the reverse indicator resets its indication of the relative position of the reverse gate to the full-up position when the reverse indicator receives a signal from the motor indicating that the reverse gate is in the full-up position.

32. In a jet propelled watercraft having a jet pump with a nozzle that outputs a jet of water rearward of the watercraft for propulsion of the watercraft, the watercraft having a hull defining a rider's area to accommodate a rider, an electrical reverse mechanism comprising:

a reverse thrust gate mounted adjacent to the nozzle and pivotable between a full-up position for full-forward propulsion and a full-down position for full-rearward propulsion; and an electrical motor that mechanically pivots the reverse gate towards the full-up position and towards the full-down position, wherein the propulsion of the watercraft is limited during watercraft operation when the reverse gate is in the full-down position in order to limit the speed at which the operator may operate the watercraft.

33. The electrical reverse mechanism of claim 32, wherein the propulsion of the watercraft is limited during watercraft operation when the reverse gate is not in the full-up position in order to limit the speed at which the operator may operate the watercraft.

* * * * *